US009384955B2

(12) United States Patent
Young et al.

(10) Patent No.: US 9,384,955 B2
(45) Date of Patent: Jul. 5, 2016

(54) MASS SPECTROMETER, CONTROL SYSTEM AND METHODS OF OPERATING AND ASSEMBLING A MASS SPECTROMETER

(71) Applicant: Micromass UK Limited, Wilmslow (GB)

(72) Inventors: Phillip Edward Young, Stockport (GB); Paul Doorbar, Cheshire (GB); Peter G. Spreadbury, Manchester (GB); Richard Newton, Sale (GB); Alan McKinnon, Cheshire (GB); Richard B. Moulds, Cheshire (GB); Richard Chapman, Cheshire (GB); Anthony J. Gilbert, High-Peak (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 14/306,269

(22) Filed: Jun. 17, 2014

(65) Prior Publication Data

US 2015/0076338 A1 Mar. 19, 2015

(51) Int. Cl.
*H01J 49/02* (2006.01)
*H01J 49/00* (2006.01)

(52) U.S. Cl.
CPC ..... *H01J 49/022* (2013.01); *H01J 49/0027* (2013.01); *Y10T 29/49117* (2015.01)

(58) Field of Classification Search
USPC ..... 250/281, 282; 702/19, 108
See application file for complete search history.

(56) References Cited

U.S. PATENT DOCUMENTS

2008/0317307 A1* 12/2008 Lu et al. ..... 382/128
2011/0093204 A1* 4/2011 Zucht ..... C07K 14/4711 702/19
2011/0270566 A1 11/2011 Riken

FOREIGN PATENT DOCUMENTS

GB 1522968 A 8/1978
GB 2484136 A 4/2012
WO 2005043575 A3 5/2005

OTHER PUBLICATIONS

Search Report Under Section 17(5) dated Jan. 17, 2014 issued in corresponding Application No. GB1310758.6.

* cited by examiner

*Primary Examiner* — Kiet T Nguyen
(74) *Attorney, Agent, or Firm* — Micromass UK Limited

(57) ABSTRACT

A mass spectrometer and methods for controlling a mass spectrometer are provided. In an exemplary embodiment, the mass spectrometer includes a plurality of discrete functional modules, each operable to perform a predetermined function of the mass spectrometer, wherein the modules are individually addressable and connected in a network. The mass spectrometer can also include a scheduler operable to introduce discrete packets of instructions to the network at predetermined times to instruct at least one module to perform a predetermined operation.

19 Claims, 4 Drawing Sheets

MASS SPECTROMETER, CONTROL SYSTEM AND METHODS OF OPERATING AND ASSEMBLING A MASS SPECTROMETER

RELATED APPLICATIONS

This application claims priority to and benefit of United Kingdom Patent Application No. 1310758.6, filed Jun. 17, 2013. The entire contents and teachings of this application are hereby expressly incorporated herein by reference in their entirety.

FIELD OF THE INVENTION

The present invention generally relates to mass spectrometers, and in particular, systems and methods for the control of mass spectrometers.

BACKGROUND OF THE INVENTION

A mass spectrometer is a highly specialised and accurate analytical apparatus for separating isotopes, molecules and molecular fragments according to their mass. Broadly speaking, a mass spectrometer comprises an ion source, analyser and a detector.

Each of these parts comprises a plurality of complex components, including but not limited to electrical, mechanical, electromechanical, or software components; or a combination thereof. Given the requirement for high accuracy and resolution in the analyses performed by a mass spectrometer, the operation of at least some of these myriad components must be accurately controlled in a synchronised manner.

The components of many existing mass spectrometers are connected across a fixed backplane, using parallel analogue signals, which arrangement provides adequate latency and speed in the communication between the logical components to ensure synchronisation. Nevertheless, such an arrangement is inflexible when reconfiguring, maintaining, repairing and/or upgrading the mass spectrometer. Moreover, the arrangement requires a central processor to control all of the components. There can be particularly high demand on the processor for certain operations of the mass spectrometer. Furthermore, the fixed backplane arrangement of a conventional mass spectrometer requires a large physical envelope.

The conventional control architecture is bespoke for a particular mass spectrometer, and thus inflexible when designing or reconfiguring mass spectrometers.

SUMMARY OF THE INVENTION

In one aspect, the present invention provides a mass spectrometer. In an exemplary embodiment, the mass spectrometer includes a plurality of discrete functional modules, each operable to perform a predetermined function of the mass spectrometer, wherein the functional modules are individually addressable and connected in a network. For example, the network can be configured as a packet switched digital network. In some embodiments, the functional modules are physically discrete from one another. In other embodiments, at least two of the functional modules can be arranged in a single physically discrete unit.

The mass spectrometer can also include a scheduler operable to introduce discrete packets of instructions to the network at predetermined times to instruct at least one functional module to perform a predetermined operation.

The functional modules can include electrical, mechanical, electromechanical and/or software components. In some embodiments, the functional modules are networked together in a hierarchy, such that the highest tier comprises the most time-critical functional modules and the lowest tier comprises functional modules which are the least time-critical. For example, the scheduler can be connected to the network at the highest tier. In some embodiments, the mass spectrometer can also include a clock associated with the scheduler. In various embodiments, the scheduler can be configured to introduce packets of instructions to the network based at least in part on data received from at least one of the functional modules through the network.

In exemplary embodiments, the highest tier can include functional modules including a vacuum control system, lens control system, quadrupole control system, electrospray module, MALDI (Matrix-Assisted Laser Desorption Ionization) source module, mass analyser, ion mobility separator, collision cell module, time of flight module, ion guide (e.g. hexapole, stepwave etc) and/or mass filter; and the lowest tier comprises functional modules including a power supply, vacuum pump and/or user display.

The mass spectrometer can also include a local scheduler to control the introduction of packets of instructions to a group of functional modules associated with the local scheduler. The mass spectrometer can also include a controller, to control the scheduler. In some embodiments, the mass spectrometer further includes memory, operable to store a plurality of packets associated with a predetermined library of predetermined operations.

In some exemplary embodiments, the mass spectrometer can include a plurality of control modules, each control module including an interface connected to a corresponding functional module and a router connected to the network and operable to receive instructions from the scheduler and to deliver the instructions to the functional module via the interface.

In another aspect, a method of operating a mass spectrometer is provided. Exemplary embodiments of the method include providing a plurality of discrete functional modules, each operable to perform a predetermined function of the mass spectrometer, wherein the functional modules are individually addressable and connected together in a network, and introducing, using a scheduler, discrete packets of instructions to the network at predetermined times to instruct at least one functional module to perform a predetermined operation.

A further aspect provides a method of assembling a mass spectrometer. Exemplary embodiments of the method include providing a plurality of discrete functional modules, each operable to perform a predetermined function of the mass spectrometer, wherein the functional modules are individually addressable; connecting the discrete functional modules in a network. The method can also include operatively connecting a scheduler to the network, the scheduler operable to introduce discrete packets of instructions to the network at predetermined times to instruct at least one functional module to perform a predetermined operation.

Another aspect provides a mass spectrometer control system. In an exemplary embodiment, the control system includes a plurality of control modules, each connectable to a corresponding one of a plurality of discrete functional modules of a mass spectrometer, each functional module being operable to perform a predetermined function of the mass spectrometer, wherein the control modules are individually addressable and connected in a network. The method can also include a scheduler operable to introduce discrete packets of instructions to the network at predetermined times to instruct at least one functional module to perform a predetermined operation.

BRIEF DESCRIPTION OF THE DRAWINGS

Embodiments of the present invention will now be described, by way of non-limiting example only, with reference to the figures in which.

DETAILED DESCRIPTION OF THE PREFERRED EMBODIMENTS

A mass spectrometer comprises many logical devices each performing a specific function which supports and/or carries out the operation of the mass spectrometer. As discussed above, broadly speaking, those logical devices together define an ion source, analyser and a detector.

Figure 1:
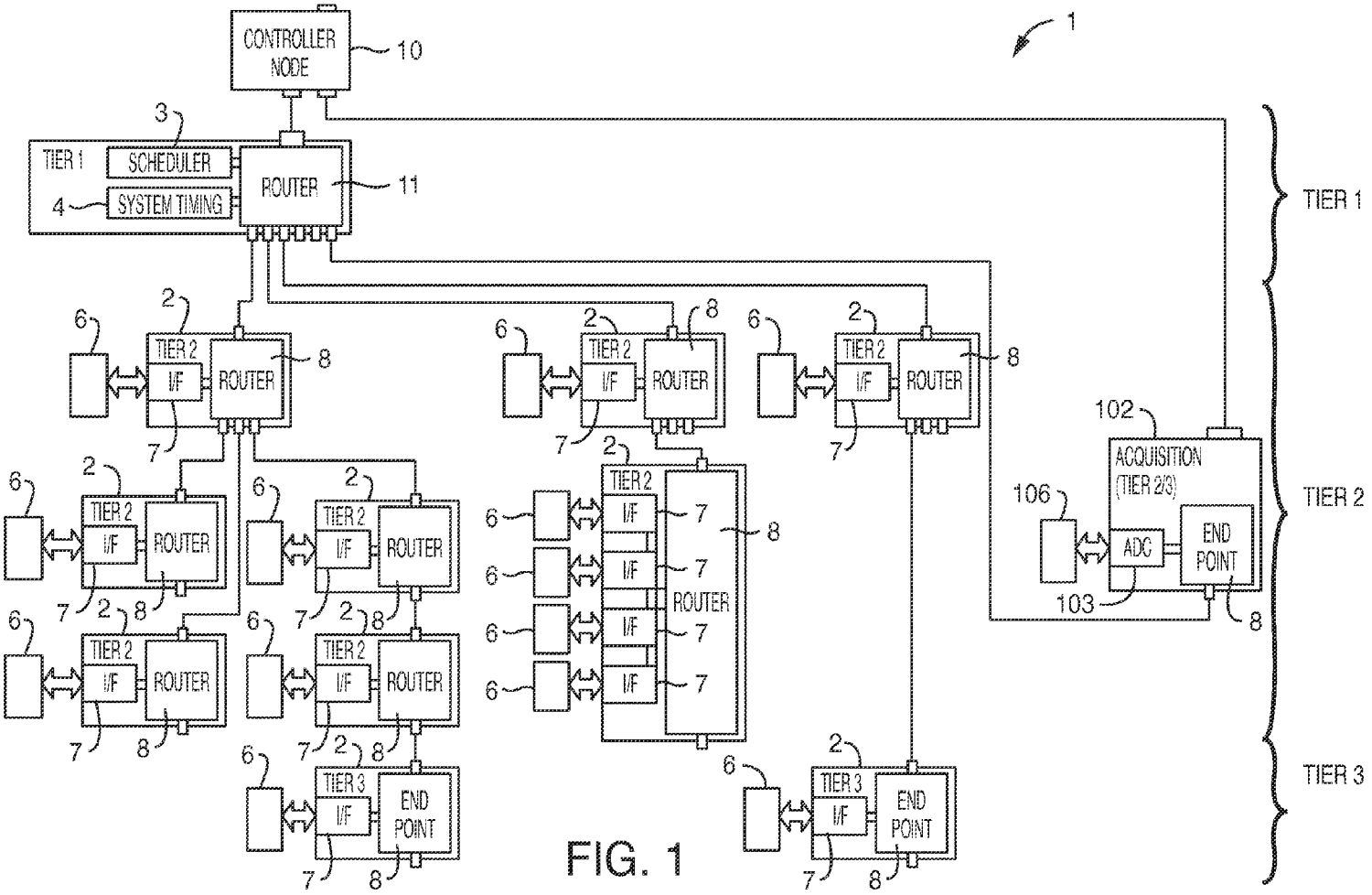
FIG. 1 shows a schematic representation of a mass spectrometer, incorporating a control system, according to the present invention.

With reference to FIG. 1, a mass spectrometer 1 according to the present invention comprises a plurality of discrete functional modules 6, wherein each functional module 6 is operable to perform a predetermined function of the mass spectrometer 1. Each functional module 6 may comprise a component or plurality of components which together perform a predetermined specific function of the mass spectrometer 1. The functional modules 6 may comprise electrical, mechanical, electromechanical, or software components; or a combination thereof. The components are configured so as to carry out, on demand, the predetermined function.

The functional modules 6 may include, but are not limited to, an electrospray module, MALDI (Matrix-Assisted Laser Desorption Ionization) source module, mass analyser, ion mobility separator, collision cell module, time of flight module, ion guide (e.g. hexapole, stepwave etc), mass filter, a vacuum pump, vacuum control system, lens control system, quadrupole control system, power supply and/or user display.

The functional modules 6 are effectively the functional blocks which together form the mass spectrometer. In FIG. 1, the plurality of functional modules 6 of the mass spectrometer 1 are shown schematically, as boxes.

The mass spectrometer 1 schematically illustrated in FIG. 1 further comprises a control system (shown independently in FIG. 4), comprising a plurality of control modules 2. Each control module 2 comprises an interface 7 and router 8. The interface 7 is connected between the respective functional module 6 of the mass spectrometer 1 and the router 8. That is to say, the functional module 6 of the mass spectrometer 1 receives control data from the control module 2 via the interface 7. Any data sent from the functional module 6 (e.g. error data, acquired measurement data etc) may be communicated via the interface 7. This is particularly of use when the mass spectrometer is operating in a data dependent acquisition (DDA) mode, wherein data generated or acquired by functional modules is used to determine the subsequent operation of the mass spectrometer.

In another embodiment, the control module 2 may be integral with a functional module 6.

The control modules 2 are networked together via their respective routers 8, via a suitable bus. Each of the functional modules 6 is individually addressable and connected together in a network. In another embodiment, the control modules 2 associated with the functional modules 6 are addressable. Any reference herein to communication between the functional modules 6 may apply equally to communication between the functional modules 6 themselves, or communication between the control modules 2 associated with the functional modules 6, as appropriate.

The discrete functional modules 6 and/or control modules 2 are self-describing in that they are operable to export a data sheet that details available inputs and outputs.

Preferably, the network is a packet switched digital network. A packet switched digital network transmits data, regardless of its nature, size and content, in suitably sized 'blocks', or packets. Preferably, the network is implemented using the SpaceWire protocol.

Communication between the functional modules 6 (and/or control modules 2) in the network can be either "point-to-point" or "up/down" a hierarchy. In point-to-point communication, there is a direct and dedicated connection between the scheduler and a given functional module 6 (and/or control modules 2). Only information from or to that functional module 6 passes along the connection. In an up/down implementation, there may be additional nodes between the scheduler and functional module 6 concerned. Other functional modules 6 may be connected to those nodes (via respective control modules 2).

FIG. 1 schematically illustrates a hierarchical arrangement of the functional modules 2, such that the highest tier comprises the most time-critical functional modules 6 and the lowest tier comprises functional modules 6 which are the least time-critical.

As an example, the highest tier of functional modules 6 (Tier 2 in FIG. 1) may comprise functional modules 6 including the vacuum control system, lens control system, quadrupole control system, electrospray module, MALDI (Matrix-Assisted Laser Desorption Ionization) source module, mass analyser, ion mobility separator, collision cell module, time of flight module, ion guide (e.g. hexapole, stepwave etc) and/or mass filter. By comparison, the lowest tier may comprise functional modules 6 including the power supply, vacuum pump, user display and/or user input/output devices.

Figure 4:
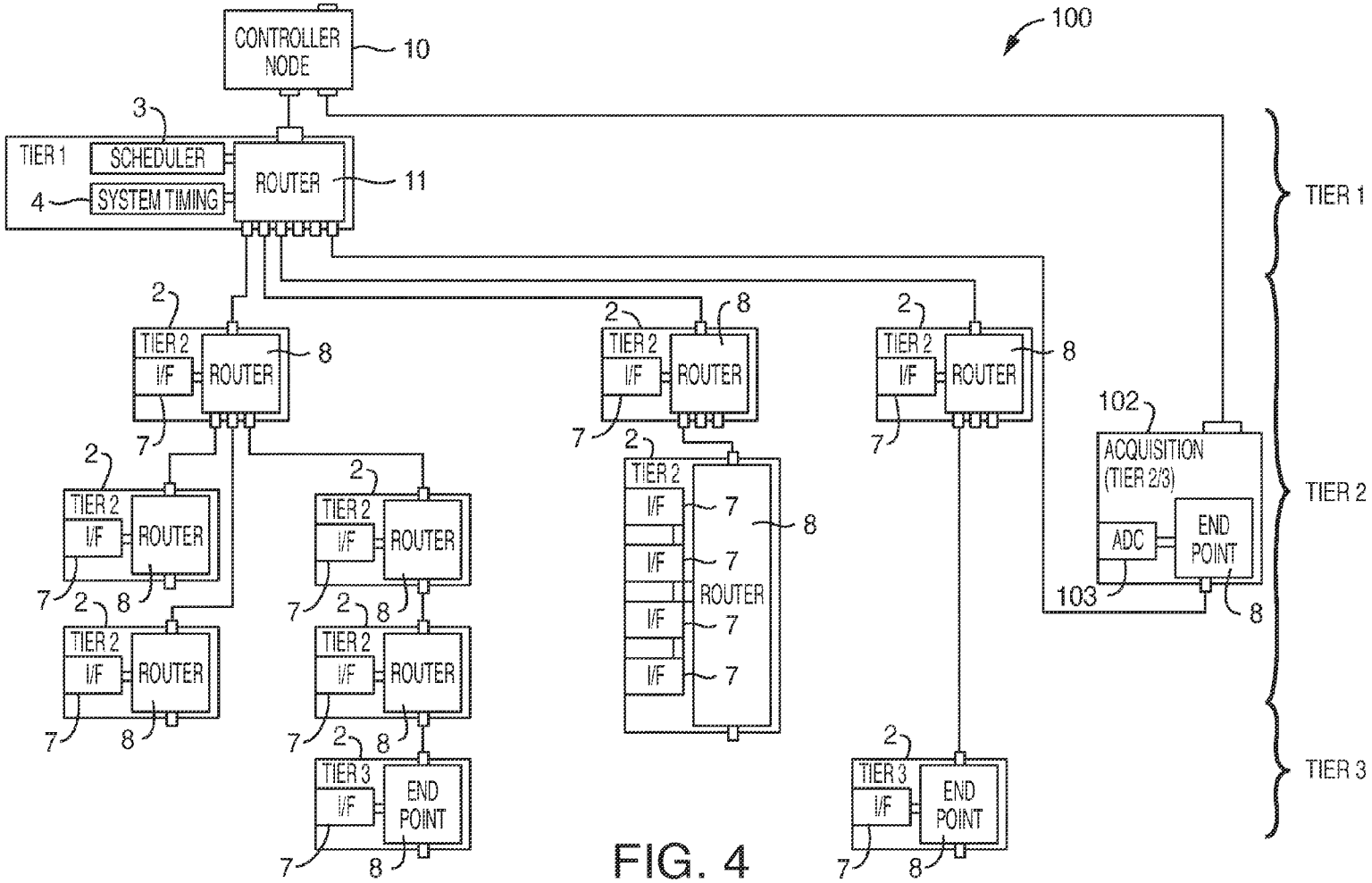
FIG. 4 shows a schematic representation of a mass spectrometer control system according to the present invention.

An acquisition control module 102 is illustrated in FIGS. 1 and 4, which is connected directly to both the controller node 10 and to the router 11. An analogue-to-digital convertor (ADC) is associated with the acquisition control module 102. The ADC incorporates the ion detection system. The functional module 106 with which the ADC detects events (and thus communicates) is a particle detector, such as a microchannel plate (MCP) detector or a photomultiplier tube (PMT).

In addition, a mass spectrometer 1 embodying the present invention further provides a scheduler 3 operable to introduce discrete packets of instructions to the network (via a router 11) to instruct at least one functional module 6 to perform a pre-determined operation. The scheduler 3 is operable to receive packets and control their introduction into the network. A given packet will be introduced by the scheduler 3 at a predetermined time based on the information in the packet and/or an associated schedule table associated with the packet.

In one embodiment, the scheduler 3, interface 7 and the logic for communication between the control modules 2 are implemented in a field-programmable gate array (FPGA). Preferably, the control modules 2 nodes may also be FPGA based.

In FIG. 1, the functional modules are schematically separated into two tiers (tier 2 and 3). There may be more tiers.

It should be noted that the schematic illustration of the functional modules arranged in a hierarchy in FIG. 1 may not necessarily be reflective of the physical arrangement of the functional modules.

Where it is important for two functional modules to operate and/or be controlled substantially in synchronisation with one another, they are preferably arranged in the same tier in the hierarchy.

Each functional module 6 (and/or control module 2) has a unique address and each of the packets sent by the scheduler 3 is addressable to a particular functional module 6, or group of functional modules 6. Each packet may contain various information such as new settings, end device sensor data, error conditions and detector data.

In one embodiment, the discrete functional modules 6 are physically discrete from one another, each being embodied in a separate unit and/or housing.

Two or more of the functional modules 6 may instead be embodied within a single physical housing, and may, for example, be embodied on a single PCB, with the PCB tracks connecting the functional modules 6 to one another and effectively providing the interface 7 and network between those functional modules 6.

As illustrated in FIGS. 1 and 4, in one embodiment, at least one control module 2 may be associated with (and thus control) more than one functional module 6. Accordingly, the control module 2 comprises a corresponding number of interfaces 7 to communicate with each respective functional module 6. Such an arrangement may be adopted where the substantially synchronous operation of the associated functional modules 6 is desired, and/or where the functional modules operate substantially collectively.

Rather than being physically discrete, functional modules may also be defined in software.

There are various different methods (operations) used by a mass spectrometer to acquire data from a sample.

Figure 2:
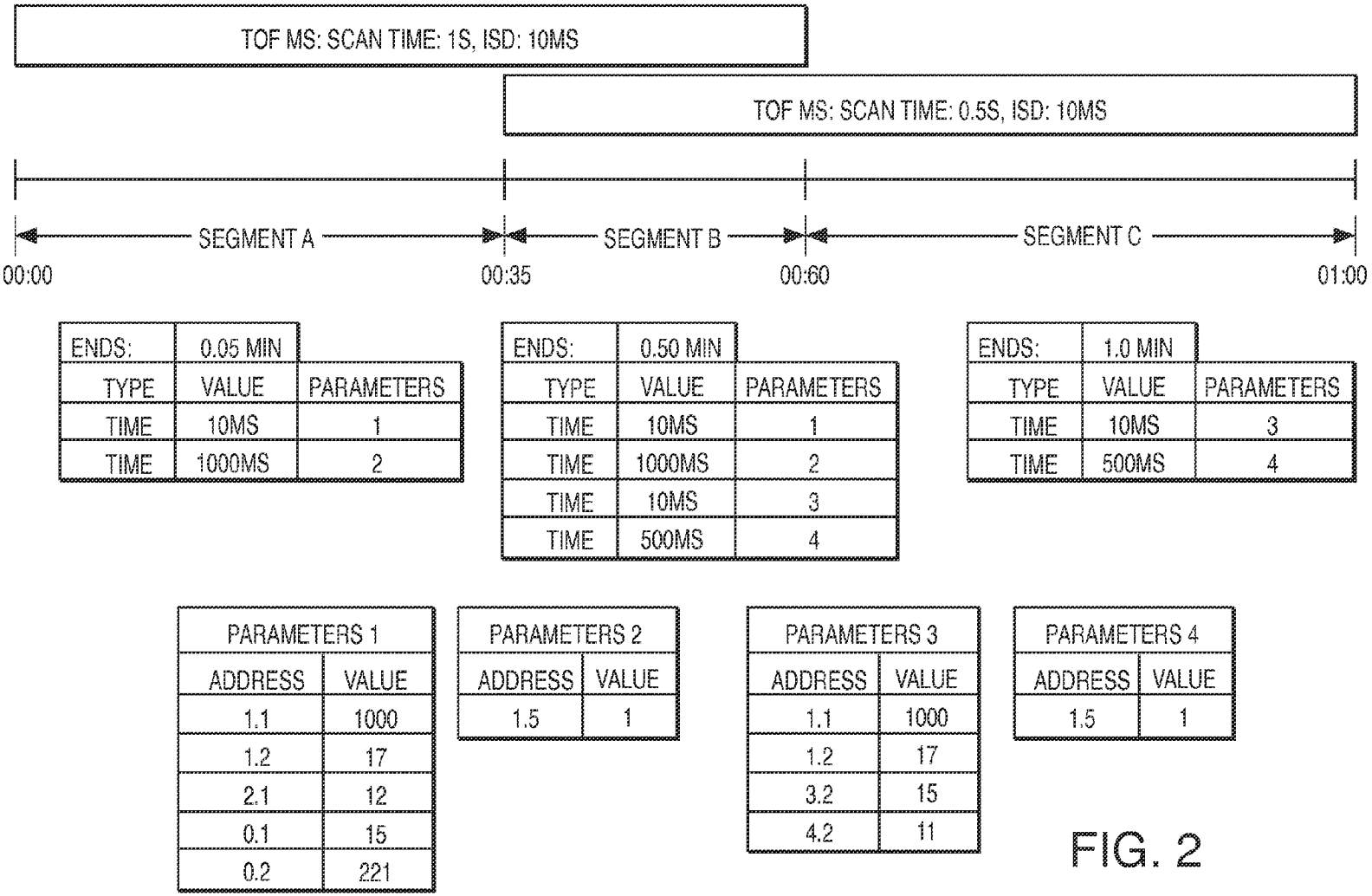
FIG. 2 shows a schematic representation of two operations being performed on a mass spectrometer according to the invention.

The control parameters for the mass spectrometer to perform a particular operation are determined by entries in a schedule table (shown in FIG. 2). Each entry in the schedule table determines the relevant settings/instructions for each of the functional modules 6, and the time at which those should be implemented.

For a given operation, the scheduler 3 interrogates the information held in the schedule table for that operation. The scheduler 3 then introduced packets of instructions for the relevant functional modules 6, at predetermined times, to run a predetermined operation. Each packet includes the address of the/each functional module 6 to be controlled (or the address of the associated control module 2).

Preferably, the mass spectrometer 1 further comprises a clock 4 (system timing) to determine and/or control when each packet should be introduced to the network. Once a packet reply is initiated, the internal clock may be reset.

Figure 3:
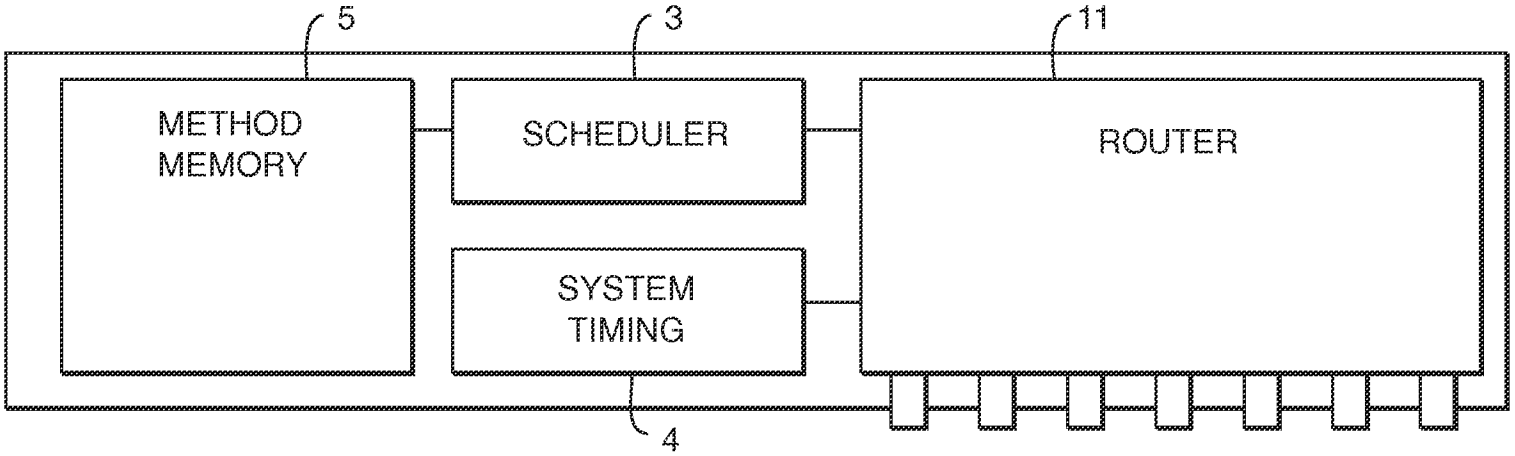
FIG. 3 shows an embodiment of the scheduler system.

In one embodiment, shown in FIG. 3, the mass spectrometer comprises memory 5 operatively connected to the scheduler 3. The memory 5 is operable to store a plurality of schedule tables and packets associated with a plurality of predetermined operations. The mass spectrometer is therefore preconfigured to acquire data from a sample using more or more of a plurality of predefined methods. Preferably, there is no need for an external host computer to control the mass spectrometer.

A particular benefit of the present invention is that the use of data packets reduces the processing load on a central CPU. Functional modules 6 are controlled locally, based on the information contained in the packets.

A data packet may be sent to one of the discrete functional modules 6 (or the control module 2) ahead of the time at which the function of that functional module 6 needs to be initiated. The packet instructions may therefore be stored in local memory in the functional module 6 or control module 2 before being implemented. A benefit of this configuration is that it eliminates the effect of any latency in the network.

As illustrated in FIG. 2, the mass spectrometer can perform predetermined operations which overlap with one another. For example, in a time of flight (TOF) implementation of a mass spectrometer, two separate data acquisition methods may be required to overlap one another. In the example shown, an MS scan is overlapped with an MSMS scan.

The overlapping of the MS and MSMS scans effectively creates three phases of operation of the mass spectrometer. The first phase is the initial part of the MS scan; the second phase comprises the final part of the MS scan and initial part of the MSMS scan; and the third phase is the final part of the MSMS scan.

By loading the relevant schedule table for each of the two predetermined operations into the scheduler, a composite schedule table is compiled. The scheduler then interrogates the composite schedule table to introduce the relevant packets onto the network at the predetermined times.

Preferably, the mass spectrometer further comprises a controller 10 associated with the scheduler 3. The controller 10 loads the scheduler 3 with all the necessary information to run a particular schedule (i.e. a predetermined operation). The scheduler 3 then, based on the entries in the schedule table, introduces packets of instructions to the network at the predetermined times.

In one embodiment, the controller node 10 is implemented in a separate field-programmable gate array (FPGA) and central processing unit (CPU). The CPU may be an Intel® based CPU. Alternatively, a CPU/FPGA hybrid could be adopted, such as the Zynq platform manufactured by Xilinx®.

The scheduler 3 can operate in two modes: asynchronous mode and synchronous mode.

In the asynchronous mode, the scheduler 3 introduces packets onto the network based on the entries in the schedule table, without feedback from the functional modules 6.

In the synchronous mode, the scheduler 3 and/or controller 10 may receive feedback from at least one of the functional modules 6, which determines which and how future packets are introduced into the network. The synchronous mode is effectively deterministic, in that the feedback received from at least one of the functional modules 6 may cause a change in the packets required to control the completion of the predetermined operation.

In the synchronous mode, the scheduler 3 is effectively prevented, by the controller, from introducing further packets onto the network. This can be implemented by introducing additional logic that forces the scheduler 3 to wait until a conditional branch signal is obtained from the controller. The controller can signal the scheduler 3 to continue or perform an entirely new schedule. The synchronous mode is suitable for an analysis whereby unknown components are to be detected and fragmented to obtain additional information on their structure, for example in data directed-type analyses.

The asynchronous mode is used when the necessary control aspects and parameters of the functional modules 6 are known ahead of time for a particular acquisition. This is of use when running an analysis on a sample to establish the presence or quantity of known compounds, such as in an MRM experiment, or a parallel fragmentation technique such as $MS^e$.

In the embodiment shown, there is a single scheduler attached to the network, preferably at the top of the network hierarchy. Additionally, there may be provided a local scheduler to control the introduction of packets of instructions to a group of modules associated with the local scheduler.

A further benefit of the present invention is that it allows for the discrete addressable functional modules to be used in a variety of mass spectrometer devices.

The invention allows for a schedule of packets to be sent onto the network at specific times and intervals during an acquisition. This reduces or alleviates the need for a host computer system with a real time operating system to control aspects of the data acquisition. The use of packets of information sent to individual functional modules reduces the processing requirements of a host computer.

The modular nature of the invention conveniently allows flexibility in the design and/or reconfiguring of a mass spectrometer. The present invention allows for at least some of the functional modules to be common across a range of mass spectrometers, and to be integrated into a design with minimal reconfiguration of other modules. Accordingly, when designing a new mass spectrometer, wholesale redesign of all the components and a bespoke control system are not necessary. A mass spectrometer may be assembled by connecting together a plurality of discrete functional modules in a network with a scheduler.

Furthermore, the modular nature of the mass spectrometer allows for a defective functional module to be replaced easily. A new functional module may simply be connected to the interface. Alternatively, if the control module is physically connected to or integral with the functional module, both can be replaced.

The present invention further provides a mass spectrometer control system 100, as schematically illustrated in FIG. 4. Like reference numbers are used to refer to like components illustrated in FIG. 1.

The mass spectrometer control system 100 comprises a plurality of control modules 2. Each control module 2 is connectable to a corresponding one of a plurality of discrete functional modules 6 of a mass spectrometer. The control modules 2 are individually addressable and connected in a network. The control system 100 further comprises a scheduler 3 operable to introduce discrete packets of instructions to the network at predetermined times to instruct at least one functional module 6 to perform a predetermined operation.

When used in this specification and claims, the terms "comprises" and "comprising" and variations thereof mean that the specified features, steps or integers are included. The terms are not to be interpreted to exclude the presence of other features, steps or components.

As will be appreciated by one skilled in the art, aspects of the present invention may be embodied as a system, method, or computer program product. Accordingly, aspects of the present invention may take the form of an entirely hardware embodiment, an entirely software embodiment (including firmware, resident software, micro-code, etc.) or an embodiment combining software and hardware aspects. All such forms may be generally referred to herein as a "system." Furthermore, aspects of the present invention may take the form of a computer program product embodied in one or more computer readable storage medium(s) having computer readable program code embodied thereon.

A computer readable storage medium may be any tangible, non-transitory medium that can contain, or store a program for use by or in connection with an instruction execution system, apparatus, or device. A computer readable storage medium may be, for example, but not limited to, an electronic, magnetic, optical, electromagnetic, infrared, or semiconductor system, apparatus, or device, or any suitable combination of the foregoing. More specific examples of the computer readable storage medium include, but are not limited to, the following: a portable computer diskette, a hard disk, a random access memory (RAM), a read-only memory (ROM), an erasable programmable read-only memory (EEPROM, EPROM, Flash memory), an optical fiber, a portable compact disc read-only memory (CD-ROM), an optical storage device, a magnetic storage device, or any suitable combination of the foregoing. Program code embodied on a computer readable storage medium may be transmitted using any appropriate medium, including but not limited to wireless, wire-line, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages.

Computer program instructions may be provided to a processor of a general purpose computer, special purpose computer, or other programmable data processing apparatus to produce a machine, such that the instructions, which execute via the processor of the computer or other programmable data processing apparatus, create means for implementing the functions, acts, or operations specified in the flowchart and block diagram block. Computer program instructions may also be stored in a computer readable storage medium that can direct a computer, other programmable data processing apparatus, or other devices to function in a particular manner, such that the instructions stored in the computer readable medium produce an article of manufacture including instructions which implement the function, act, or operation specified in the flowchart and block diagram block.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions, acts, or operations specified in the flowchart or diagram block.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realising the invention in diverse forms thereof.

While the invention has been shown and described with reference to specific preferred embodiments, it should be understood by those skilled in the art that various changes in form and detail may be made therein without departing from the spirit and scope of the invention as defined by the following claims.

What is claimed is:

1. A mass spectrometer comprising:

a plurality of discrete functional modules, each operable to perform a predetermined function of the mass spectrometer, wherein the functional modules are individually addressable and connected in a network, wherein the functional modules are networked together in a hierarchy, such that the highest tier comprises the most time-critical functional modules and the lowest tier comprises functional modules which are the least time-critical; and a scheduler operable to introduce discrete packets of instructions to the network at predetermined times to instruct at least one functional module to perform a predetermined operation.

2. A mass spectrometer according to claim 1, wherein the functional modules comprise electrical, mechanical, electromechanical and/or software components.

3. A mass spectrometer according to claim 1, wherein the scheduler is connected to the network at the highest tier.

4. A mass spectrometer according to claim 1, wherein the highest tier comprises functional modules including a vacuum control system, lens control system, quadrupole control system, electrospray module, MALDI (Matrix-Assisted Laser Desorption Ionization) source module, mass analyser, ion mobility separator, collision cell module, time of flight module, ion guide (e.g. hexapole, stepwave etc) and/or mass filter; and the lowest tier comprises functional modules including a power supply, vacuum pump and/or user display.

5. A mass spectrometer according to claim 1, further comprising a clock associated with the scheduler.

6. A mass spectrometer according to claim 1, wherein the scheduler is configured to introduce packets of instructions to the network based at least in part on data received from at least one of the functional modules through the network.

7. A mass spectrometer according to claim 1, further comprising a local scheduler to control the introduction of packets of instructions to a group of functional modules associated with the local scheduler.

8. A mass spectrometer according to claim 1, wherein the network is configured as a packet switched digital network.

9. A mass spectrometer according to claim 1, further comprising a controller, to control the scheduler.

10. A mass spectrometer according to claim 1, further comprising memory, operable to store a plurality of packets associated with a predetermined library of predetermined operations.

11. A mass spectrometer according to claim 1, further comprising a plurality of control modules, each control module comprising:

an interface connected to a corresponding functional module; and a router connected to the network and operable to receive instructions from the scheduler and to deliver the instructions to the functional module via the interface.

12. A mass spectrometer according to claim 1, wherein the functional modules are physically discrete from one another.

13. A mass spectrometer according to claim 1, wherein at least two of the functional modules are arranged in a single physically discrete unit.

14. A method of assembling a mass spectrometer comprising:

providing a plurality of discrete functional modules, each operable to perform a predetermined function of the mass spectrometer, wherein the functional modules are individually addressable;

connecting the discrete functional modules in a network, wherein the functional modules are networked together in a hierarchy, such that the highest tier comprises the most time-critical functional modules and the lowest tier comprises functional modules which are the least time-critical; and operatively connecting a scheduler to the network, the scheduler operable to introduce discrete packets of instructions to the network at predetermined times to instruct at least one functional module to perform a predetermined operation.

15. A method according to claim 14, wherein the scheduler is connected to the network at the highest tier.

16. A method according to claim 14, wherein the highest tier comprises functional modules including a vacuum control system, lens control system, quadrupole control system, electrospray module, MALDI (Matrix-Assisted Laser Desorption Ionization) source module, mass analyser, ion mobility separator, collision cell module, time of flight module, ion guide (e.g. hexapole, stepwave etc) and/or mass filter; and the lowest tier comprises functional modules including a power supply, vacuum pump and/or user display.

17. A mass spectrometer control system, comprising:

a plurality of control modules, each connectable to a corresponding one of a plurality of discrete functional modules of a mass spectrometer, each functional module being operable to perform a predetermined function of the mass spectrometer, wherein the control modules are individually addressable and connected in a network, wherein the functional modules are networked together in a hierarchy, such that the highest tier comprises the most time-critical functional modules and the lowest tier comprises functional modules which are the least time-critical; and a scheduler operable to introduce discrete packets of instructions to the network at predetermined times to instruct at least one functional module to perform a predetermined operation.

18. A mass spectrometer control system to claim 17, wherein the scheduler is connected to the network at the highest tier.

19. A mass spectrometer control system according to claim 17, wherein the highest tier comprises functional modules including a vacuum control system, lens control system, quadrupole control system, electrospray module, MALDI (Matrix-Assisted Laser Desorption Ionization) source module, mass analyser, ion mobility separator, collision cell module, time of flight module, ion guide (e.g. hexapole, stepwave etc) and/or mass filter; and the lowest tier comprises functional modules including a power supply, vacuum pump and/or user display.

* * * * *